US005921423A

United States Patent [19]

Howell et al.

[11] Patent Number: 5,921,423

[45] Date of Patent: Jul. 13, 1999

[54] STACKABLE REUSABLE FOOD DELIVERY TRAY FOR SIMULTANEOUS SERVING OF HOT AND COLD FOOD

[75] Inventors: Harold R. Howell, West Lafayette; Alford D. Miskimen, Newcomerstown, both of Ohio

[73] Assignee: Jones Metal Products Co., West Lafayette, Ohio

[21] Appl. No.: 08/846,235

[22] Filed: Apr. 28, 1997

Related U.S. Application Data

[51] Int. Cl.[6] ..... B65D 21/036

[52] U.S. Cl. ..... 220/23.86; 220/574; 220/575; 220/556; 220/23.88; 206/508; 206/509; 206/511

[58] Field of Search ..... 220/23.83, 23.86, 220/574, 575, 4.27, 556, 555, 523, 524, 23.4, 23.8, 23.87, 23.88; 206/509, 508, 511, 503, 549, 541, 315.11

[56] References Cited

U.S. PATENT DOCUMENTS

| | | | |
|---|---|---|---|
| 2,944,694 | 7/1960 | Kinsey | 220/23.83 |
| 3,612,635 | 10/1971 | Uyeda et al. | 206/315.11 |
| 5,007,552 | 4/1991 | Sage et al. | 220/23.83 |
| 5,366,069 | 11/1994 | Seidner | 220/23.83 |
| 5,699,925 | 12/1997 | Petruzzi | 206/509 |

FOREIGN PATENT DOCUMENTS

| | | | |
|---|---|---|---|
| 2 239 971 | 4/1975 | France | 220/556 |
| 2 700 755 | 7/1994 | France | 206/541 |
| 7192 | of 1912 | United Kingdom | 220/23.86 |

*Primary Examiner*—Stephen Castellano

*Attorney, Agent, or Firm*—Kremblas, Foster, Millard & Pollick

[57] ABSTRACT

A food tray delivery system is provided having a carrying tray, preferably two food trays, and preferably two lids. The carrying tray has a base and a generally upwardly extending sidewall, with the base having an upper surface and a lower surface. The carrying tray is adapted to carry the two food trays. Preferably each food tray has three food retention areas, with each food retention area having a food retention area upper surface and a generally upwardly extending sidewall, with adjacent food retention areas separated by a transverse sidewall. Each transverse sidewall extends between opposing sidewall surfaces of the food tray. Each food tray also has a bottom surface having downwardly depending ribs adapted to cooperate with a lid to permit stacking. Each lid preferably has a recessed area, as well as being adapted to cooperatively fit together with a food tray.

12 Claims, 10 Drawing Sheets

STACKABLE REUSABLE FOOD DELIVERY TRAY FOR SIMULTANEOUS SERVING OF HOT AND COLD FOOD

FIELD OF THE INVENTION

This invention concerns an improved food delivery tray, and more specifically one which is both stackable and reusable, and which permits the simultaneous serving of hot foods and cold foods.

BACKGROUND OF THE INVENTION

The ingestion of food is a necessity in order for an individual to survive. Many individuals are able to partake of food at a location of their own choosing. However, some individuals experience periods of confinement, during which food must be brought to them. For example, an individual may be confined to a hospital or nursing home bed. Or, an individual who is able to walk about their home may need a meal periodically delivered there, either due to their inability to prepare appropriate portions of food or perhaps due to economic hardship. Finally, there is the extremely large inmate population at correctional institutions, many of whom have their meals brought to their prison cell.

Regardless of the environment, food delivery systems have designed reusable food delivery trays for use in such situations. Due to the variety of foods served to these individuals at any one meal, the food trays have been partitioned so as to typically accommodate one type of food in each food retention area. The presence of individual food retention areas keeps syrups, juices, or sauces associated with any one product from coming into contact with an adjacent food selection, thus possibly adversely affecting the aesthetic taste associated with that food.

As noted above, one place where reusable food delivery trays are used is the corrections environment. Many correctional facilities have attempted to dispense food using buffets, or a cafeteria-style environment. Both of these methods for the delivery of food often result in food waste, since inmates may partake of just some of the foods available to them, leaving others virtually untouched, thereby contributing to waste. Another significant problem facing corrections facilities is that the feeding of individuals by either of these methods requires the congregation of individuals into large enough groups which raise security concerns. Therefore, the ability to feed individuals without them leaving their cell or area of confinement, as well as through the use of portion-control has been found to be extremely desirable.

A more perplexing problem concerns the simultaneous serving to such individuals on a food delivery tray of both hot and cold/room temperature foods. One example of prior art food delivery tray is a single plastic tray having molded therein a plurality of food compartments. Individual food portions are placed in each of the respective food compartments. These trays are stackable so that the bottom of a first tray effectively becomes the lid for a second tray stacked underneath. Typically this type of prior art tray is filled with a foam insulation to assist with the retaining of the heat associated with the hot foods, with the foam insulation further assisting with keeping the hot foods hot and the cold foods cold.

However, there are several drawbacks associated with this particular tray. First, the hot foods and cold foods cannot be prepackaged separately prior to placement in the food compartments. At best, while the cold foods may be placed in the food compartments ahead of time, the hot foods must be placed there just shortly prior to serving. Furthermore, in some correctional facilities, the opening in the cell door through which the tray must pass could be more narrow than the width of a given tray, therefore, necessitating the opening of the door, creating a possible safety risk. Still further, the fact that this particular tray has no lid once it is delivered to the individual who will actually eat the food, results in the immediate cooling of the hot food upon delivery, even though the individual may not be ready to begin eating at that moment. Thus, the possibility exists that food which once was hot could be cold by the time the individual actually begins eating.

Another proposed solution to this problem is the fabrication of a delivery tray having a number of compartments, with that particular tray system also having a second tray which is placed on the first tray, with the second tray containing only hot foods. This, second tray also comes equipped with a lid. The presence of the lid with the second tray allows the prepackaging of the hot foods, however, the fact that no such lid exists for the compartments dedicated to cold/room temperature foods precludes their prepackaging on the tray. Additionally, with respect to this delivery tray system, there is no provision made as to silverware, such that it must be supplied separately from the tray delivery system, thus requiring additional steps, time, and more work in the meal delivery process. Once again, an additional drawback is that the width of at least the cold/room temperature food tray may be too wide for some narrow openings in correctional doors. It is thus apparent that the need exists for an improved food delivery tray or the like for use with food delivery systems.

SUMMARY OF THE INVENTION

The problems associated with developing a food delivery tray system are overcome in accordance with the present invention by forming of a food tray delivery system for serving food to an individual with the food tray delivery system having a carrying tray, at least one food tray and at least one lid. The carrying tray has a base and a generally upwardly extending sidewall, with the base having an upper surface and a lower surface. The food tray includes at least one food retention area, with the food retention area having a food retention area upper surface and a generally upwardly extending sidewall. The carrying tray is adapted to carry the food tray. Similarly, the lid and food tray are adapted to cooperatively fit together.

In the preferred embodiment of the invention, there are two food trays. Preferably, each food tray includes a plurality of food retention areas, which in the preferred embodiment of the invention is three, and with these food retention areas separated by a transverse sidewall, each transverse sidewall extending across the food tray to the opposite side thereof.

Each food tray has a bottom surface with a plurality of ribs adjacent thereto. The ribs have formed therein grooves, with the grooves being aligned such that the transverse sidewall portions of a first food tray cooperatively engage within the corresponding grooves of a second food tray so as to permit the stacking of food trays. Each food tray has downwardly depending ribs extending from its bottom surface, with each lid being adapted to cooperate with the downwardly depending ribs.

The lid component of this invention includes a recessed area. Moreover, in the preferred embodiment of the invention the first food tray is of a first color while the second food tray is of a second color.

There is also disclosed a food tray delivery system for serving food to an individual with the food tray delivery system having a carrying tray, two food trays and two lids. The carrying tray has a base and a generally upwardly extending sidewall, with the base having an upper surface and a lower surface. The food tray includes three food retention areas, with the food retention area having a food retention area upper surface and a generally upwardly extending sidewall. The carrying tray is adapted to carry the food tray. Similarly, the lid and food tray are adapted to cooperatively fit together. Adjacent food retention areas are separated by a transverse sidewall. Each food tray also has a bottom surface, with the bottom surface having downwardly depending ribs, such that the lid to cooperatively engages with the downwardly depending ribs. The carrying tray is also adapted to carry the food trays. The lid has a recessed area, and the lid and food tray are adapted to cooperatively fit together.

With respect to this invention, the bottom surface is formed having a plurality of ribs adjacent thereto, with the ribs having formed therein grooves. The grooves in adjacent ribs are aligned such that the transverse sidewall portions of a first food tray cooperatively engage within the corresponding grooves of a second food tray so as to permit the stacking of food trays. Moreover, in the preferred embodiment of the invention the first food tray is of a first color while the second food tray is of a second color.

It is the primary object of the present invention to provide a food delivery tray which is reusable, and able to effectively serve both hot and cold foods.

A further objective is that such a food delivery tray be easy to fabricate, inexpensive and adaptable, especially if the food delivery tray is used in a corrections environment.

Other objects and advantages of the invention will be apparent from the following description, the accompanying drawings and the appended claims.

DETAILED DESCRIPTION OF THE INVENTION

Figure 1:
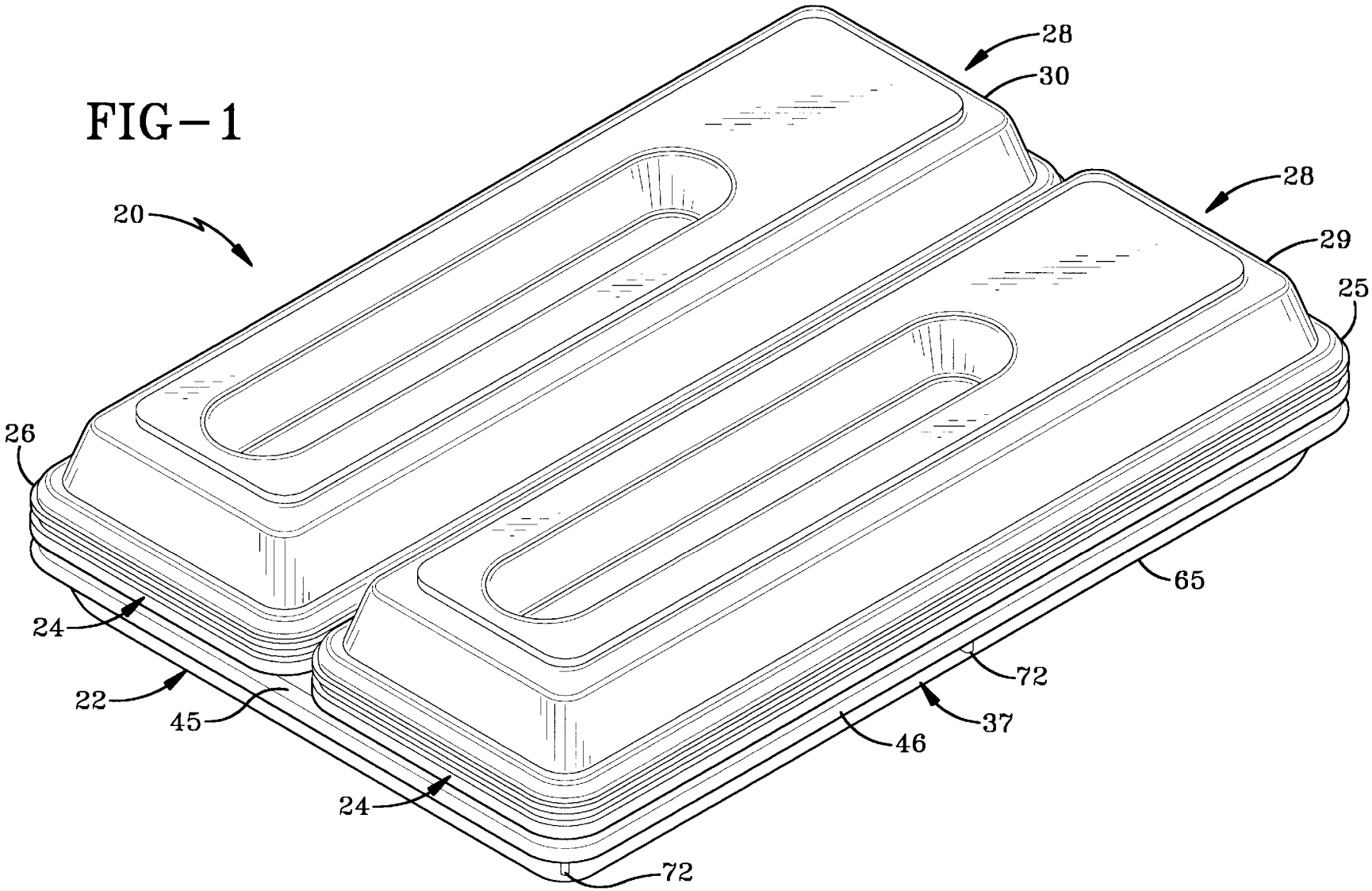
FIG. 1. is a perspective view of a container for use as a food delivery tray made in accordance with the present invention.

Having reference to the drawings, attention is first directed to FIG. 1 which discloses a food tray delivery system 20 embodying this invention. The unique food tray delivery system 20 of this invention includes as its principal components a carrying tray 22, and at least one food tray 24 with lid 28. In the preferred embodiment of the invention shown in FIG. 1, the carrying tray is dimensioned such that it can accommodate a first food tray 25 as well as a second food tray 26, with the first food tray 25 having associated therewith a first food tray lid 29, while the second food tray has associated therewith a second food tray lid 30. Preferably the components of this food tray delivery system are fabricated from material such as high density polyethylene (HDPE) and polycarbonate.

Figure 2:
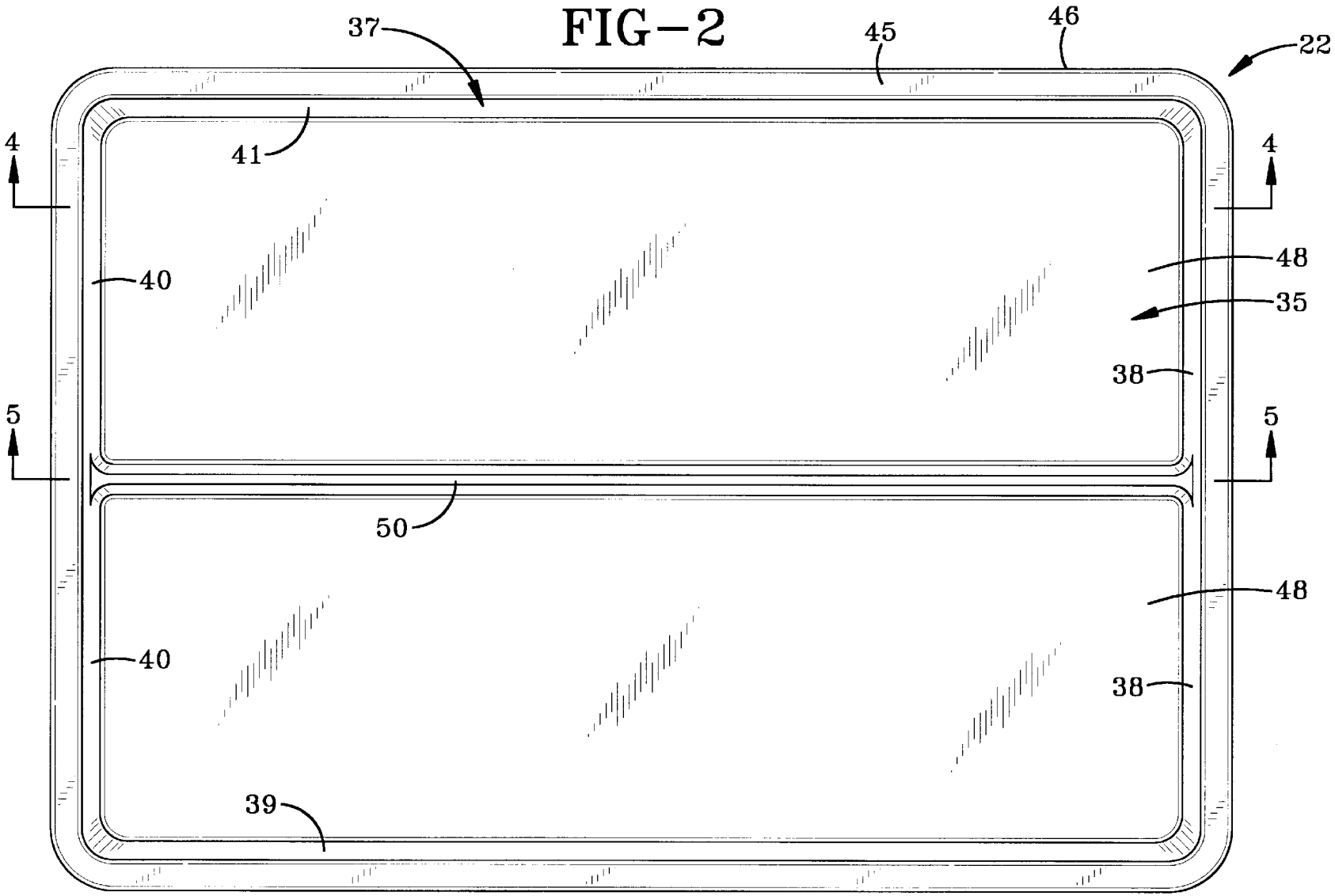
FIG. 2 is a top elevational view of the carrying tray component of the invention.

With respect to the carrying tray 22, its structure may best be appreciated from a comparison of FIGS. 2, 3, 4, and 5. FIG. 2 shows the carrying tray when viewed from above with the carrying tray having a base 35 and a carrying tray sidewall 37. The sidewall associated with the carrying tray has a first wall 38, a second wall 39, a third wall 40, and a foul th wall 41, all of which in the preferred embodiment correspond to the various sides of the rectangularly shaped carrying tray. Associated with the carrying tray sidewall 37 is its interior surface 43 which extends completely around the carrying tray base 35. Adjacent the top of the sidewall interior surface 43 is a peripheral flange 45 which extends outwardly from the sidewall 37, and which is in addition preferably parallel to the carrying tray base 35. This peripheral flange terminates in a rounded edge 46. As can best be appreciated from a comparison of FIGS. 2 and 5, the carrying tray base 35 has extending upwardly from its base upper surface 48 a longitudinally extending rib 50. The height of this rib is not as great as the height associated with the carrying tray sidewall itself. However, it is of a sufficient height to restrain the movement of the food trays when placed thereon as shown in FIG. 1.

Figure 3:
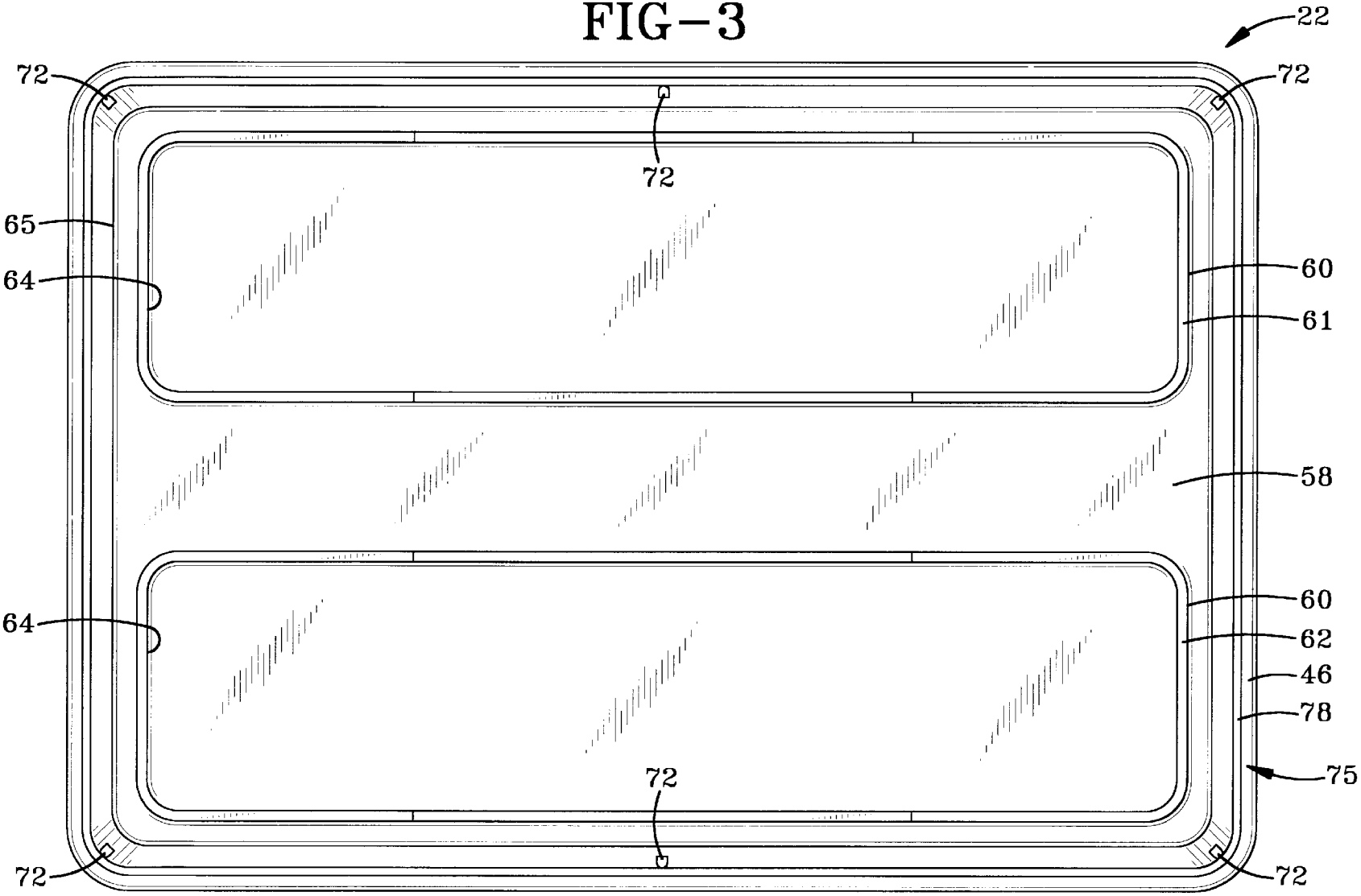
FIG. 3 is a bottom elevational view of the carrying tray component of the invention.
Figure 4:
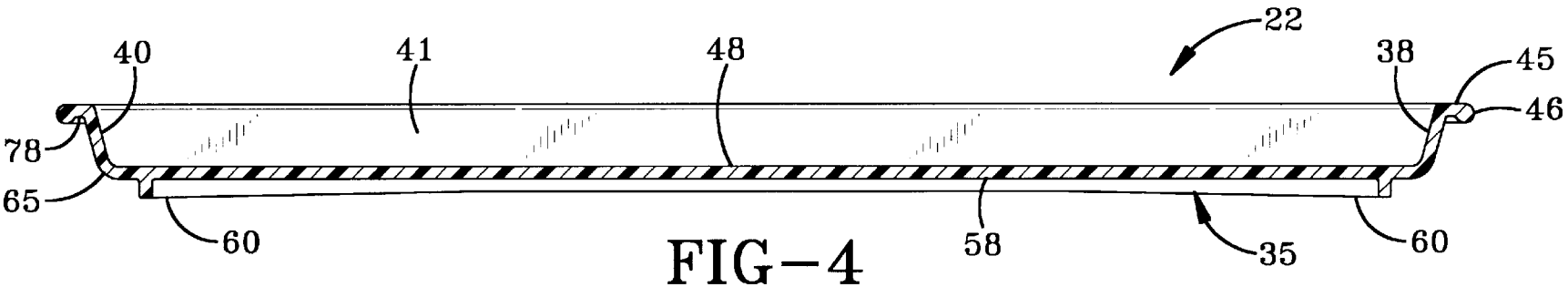
FIG. 4 is a vertical sectional view taken along line 4—4 of FIG. 1.
Figure 5:
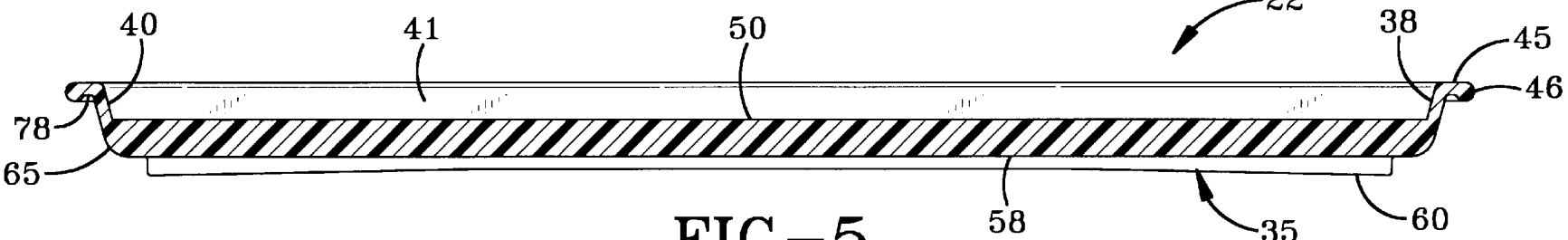
FIG. 5 is a vertical sectional view taken along line 5—5 of FIG. 2.

The carrying tray 22, has as can best be appreciated from a comparison of FIGS. 3, 4, and 5 a lower surface 58. Arguably the most pronounced features of this lower surface 58 are downwardly depending rib structures 60 shown, in FIG. 3 as a first rib 61 and a second rib 62. Each rib has a generally rectangular layout on the bottom of the carrying tray. The dimensions associated with these downwardly depending rib structure 60 will be explained later, since they cooperate with structural components of the lids 28. The downwardly depending rib structure 60 features a rib inner wall 64.

At the edges of the base lower surface 58 is a rounded peripheral edge 65 above which extends the carrying tray sidewall exterior surface 70. With reference to FIGS. 1 and 3, it will be noted that there are preferably a plurality of nubs 72 located on the exterior surface 70, specifically at the corners and at the mid-points of the longest two sides of the tray. The bottom of each nub is preferably planar and parallel to the base of the carrying tray.

From a comparison of FIGS. 3, 4 and 5, it will be appreciated that the peripheral flange 45 has associated therewith a flange lower surface 75 with the planar surface portion 78 extending between the rounded edge 46 of the peripheral flange 45 and the sidewall 37.

The following are the dimensions associated with the preferred embodiment of the invention. The length of the carrying tray is roughly 14¼"×10", including measuring from the ends of the peripheral flange 45 which extend around the tray 22. The approximate dimensions from the interior edge of the peripheral flange 45 are 13½"×9¼". The thickness of the base and sidewalls are approximately ⅛", with an additional ¼" height associated with the longitudinally extending rib 50. The downwardly depending ribs 60 are also approximately ⅛" wide and form a rectilinear configuration with rounded comers with the dimensions associated with the sides of the layout being 3"×12⅜", with those distances being roughly the distances between the rib inner walls 64. The distance from the upper surface of the peripheral flange 45 to the lower surface of the downwardly depending ribs 60 is approximately 1" with the vertical distance from the top of the peripheral flange 45 to the top of the carrying tray base 48 being ⅝", and the height of the downwardly depending rib structure being ⅛".

With respect to nubs 72 the bottom of the nubs is approximately ⅛", with the exterior sidewall of the nub being, in the preferred embodiment, generally perpendicular to the nub's base. Thus it will be appreciated that the carrying trays when stacked one upon another will have the base of the nubs coming into contact with the upper surface of the peripheral flange 45.

Turning now to a discussion of the structure of the food trays 22, attention is directed to FIGS. 6–10. With respect to the two food trays shown in FIG. 1, both are identical, such that the discussion of a single food tray will suffice for disclosing the features associated with the food tray 24. The food trays have as their two most visible features food retention area 81 and food tray sidewall 85. Preferably there are a plurality of food retention areas each with a retention area upper surface 88.

The food tray sidewall 85 has an inner surface 90 and a top edge 92. As can best be appreciated from a comparison of FIGS. 8–10, the food tray sidewall 85 also has an exterior surface top portion 95 and an exterior surface bottom portion 97. With respect to the food tray sidewall exterior surface top portion 95, preferably two pairs of detents 96 are formed in the exterior surface top portion at opposite longitudinal ends of the food tray. How these detents function is explained below with reference to the nubs associated with the lid 28.

As can be appreciated from a comparison of FIGS. 6, 8–10, there is also an exterior sidewall flange 100 having a flange top edge 102, a flange outer edge 104, a flange lower edge 106, and an intermediate surface portion 108 which extends between the flange lower edge 106 and the exterior sidewall bottom portion 97.

Figure 6:
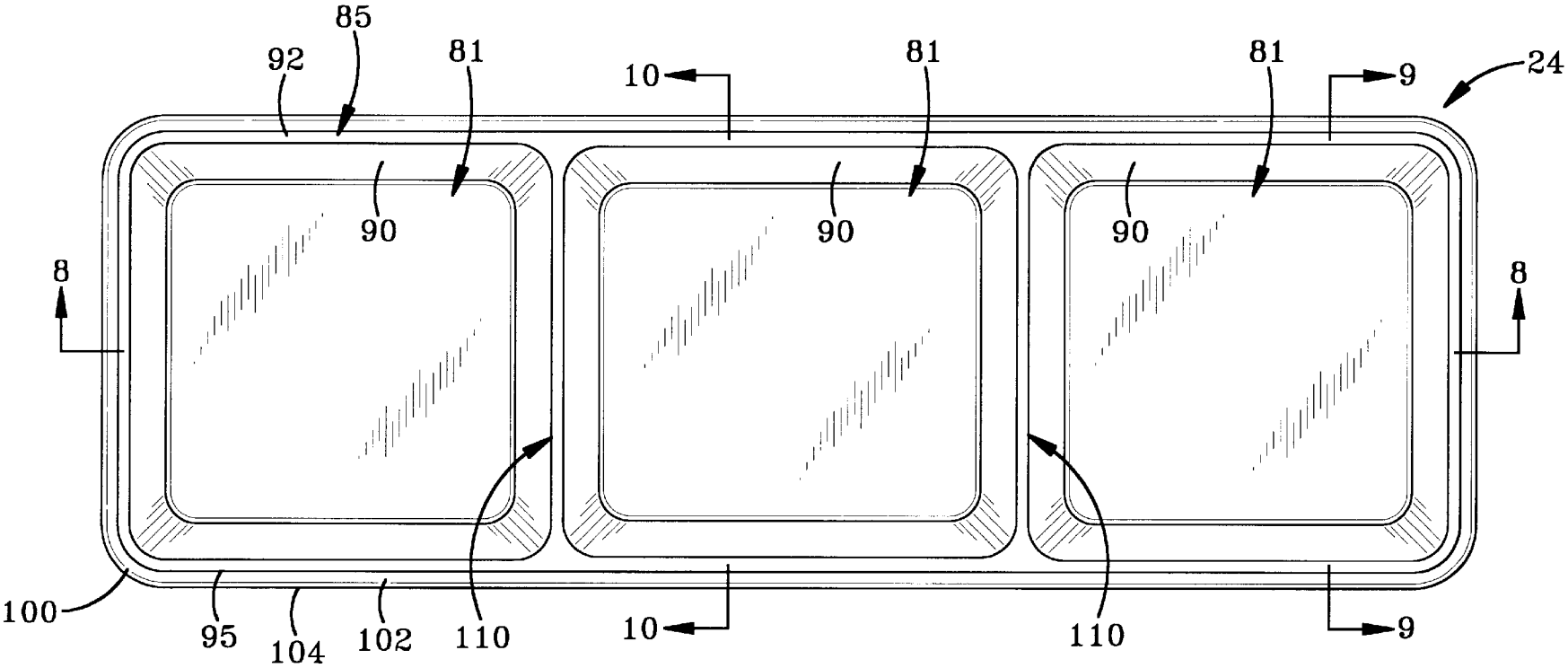
FIG. 6 is a top elevational view of a food tray associated with the invention.
Figure 7:
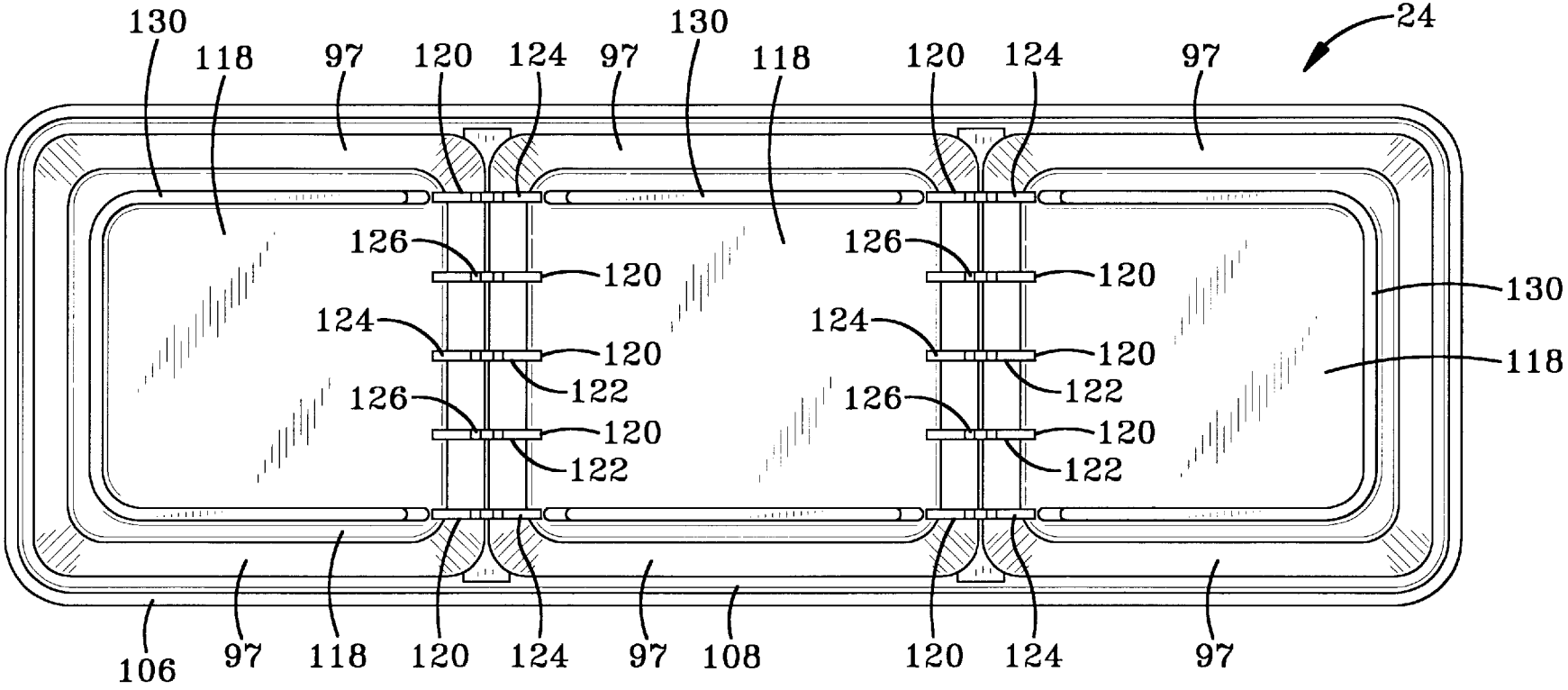
FIG. 7 is a bottom elevational view of a food tray associated with the present invention.
Figure 8:
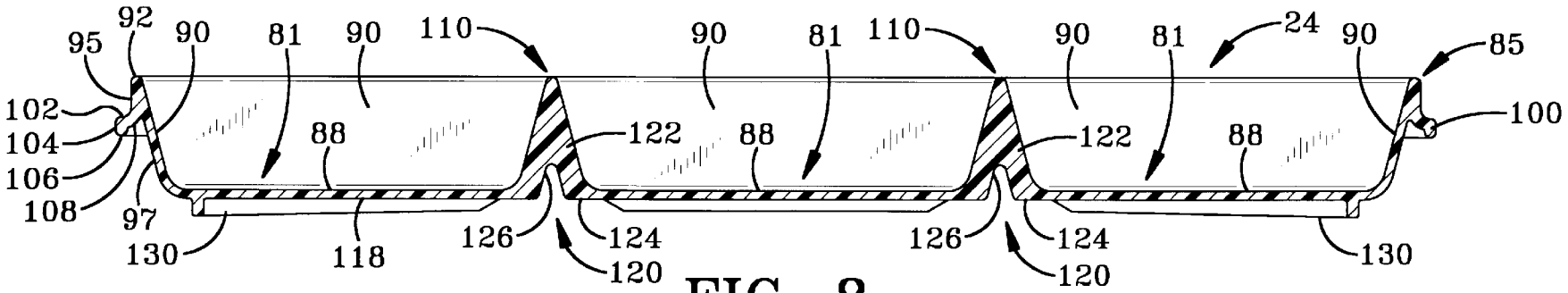
FIG. 8 is a vertical sectional view taken along line 8—8 of FIG. 6.
Figure 10:
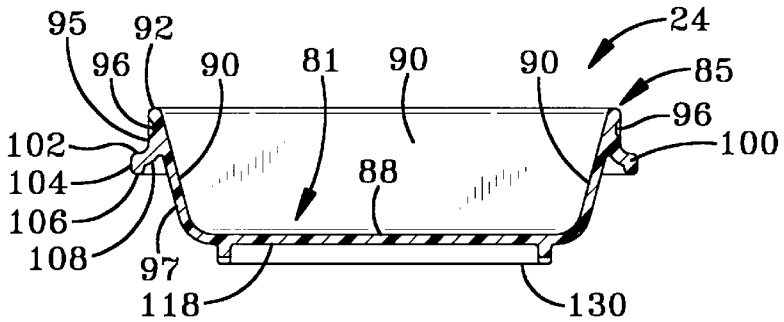
FIG. 10 is a vertical sectional view on an enlarged scale taken along line 10—10 of FIG. 6.
Figure 9:
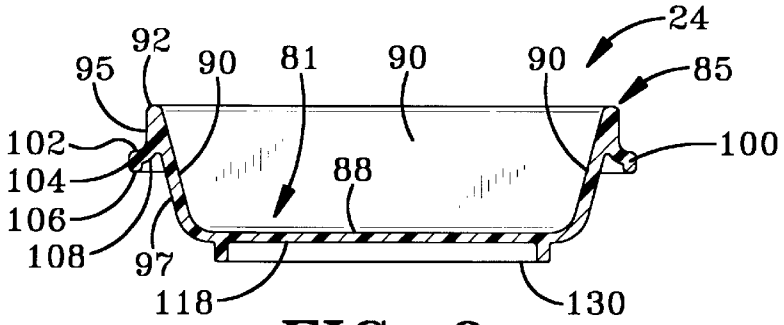
FIG. 9 is a vertical sectional view on an enlarged scale taken along line 9—9 of FIG. 6.
Figure 11:
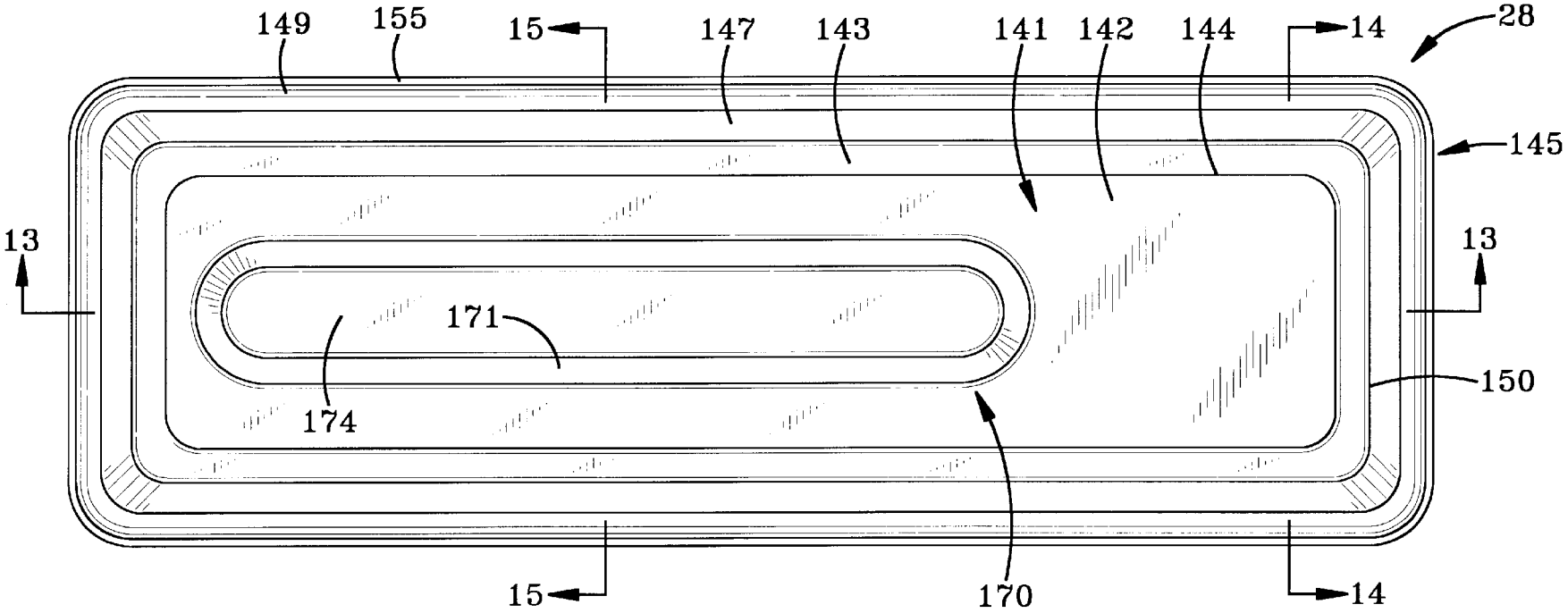
FIG. 11 is a top elevational view of the lid associated with the invention.
Figure 12:
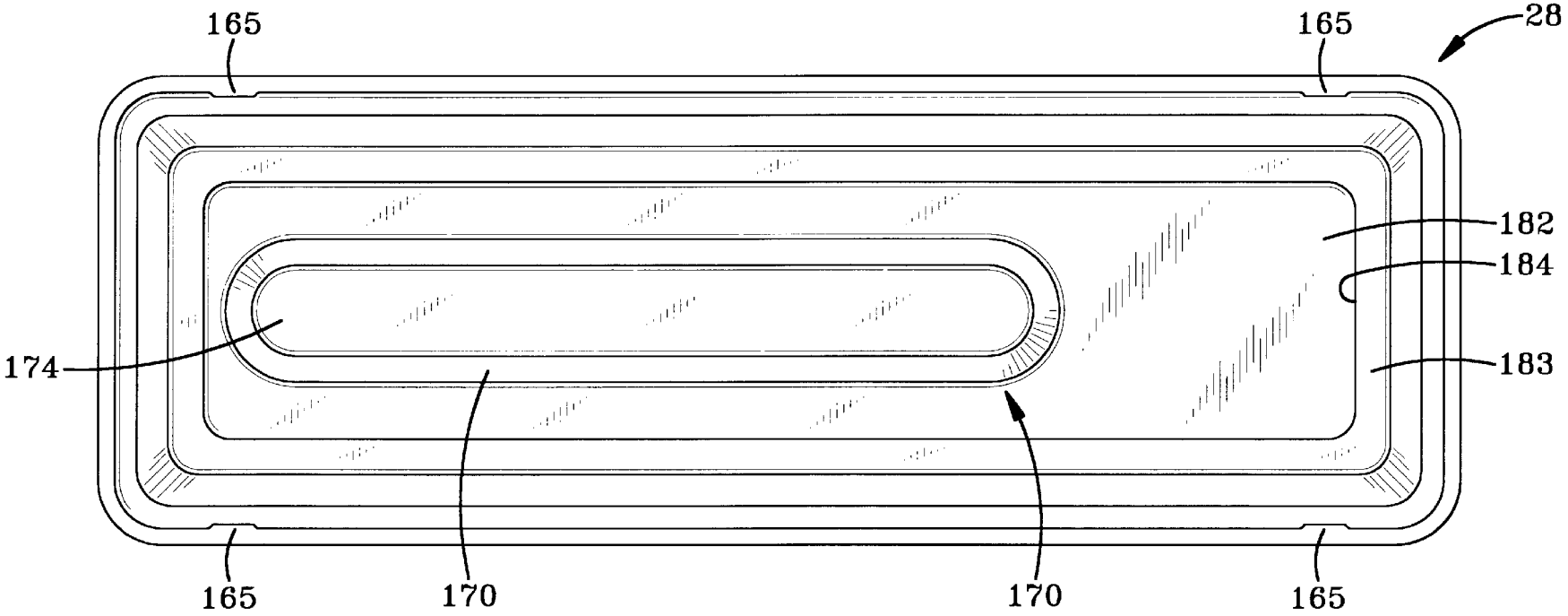
FIG. 12 is a bottom elevational view of the lid associated with this invention.
Figure 13:
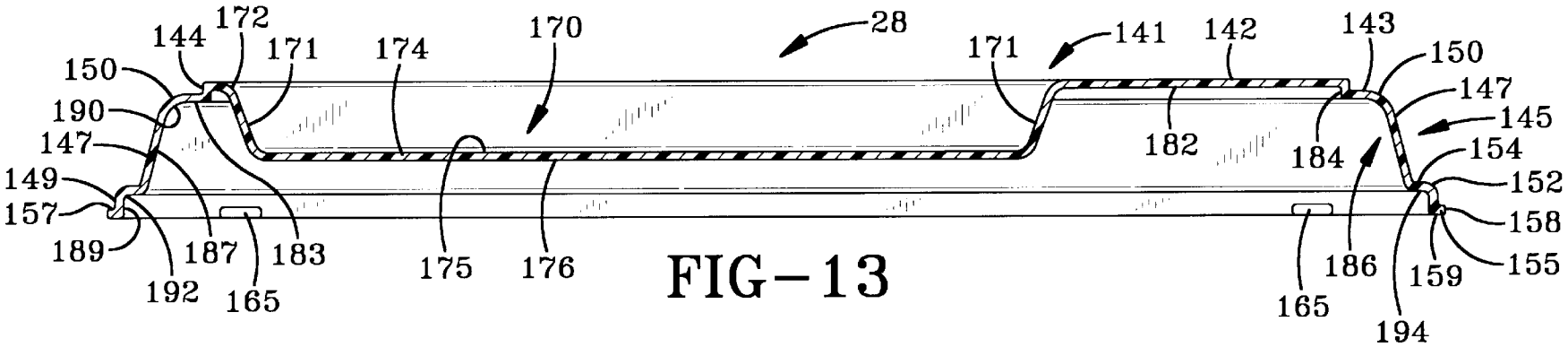
FIG. 13 is a vertical sectional view taken along line 13—13 of FIG. 11.
Figure 15:
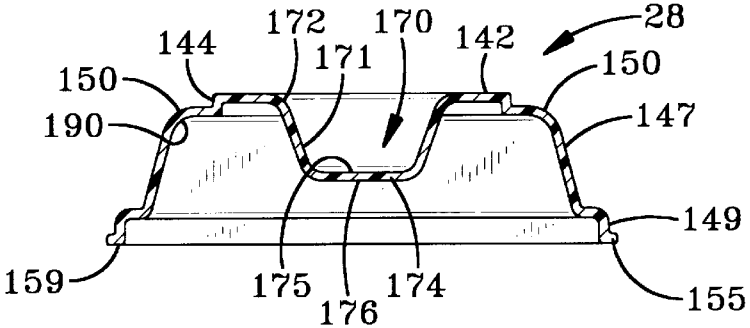
FIG. 15 is a vertical sectional view taken on enlarged scale along line 15—15 of FIG. 11.
Figure 14:
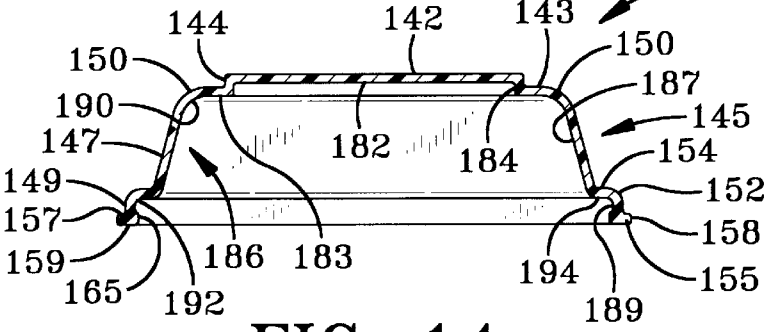
FIG. 14 is a vertical sectional on an enlarged scale taken along line 14—14 of FIG. 11.

FIGS. 6, 7, and 8 disclose the presence of transverse sidewall portions 110 which extend between the two most elongated portions of the food tray sidewall 85. Each food retention area, of which there, are three in the preferred embodiment, of the invention also have associated therewith a bottom surface 118. Connecting adjacent food retention areas are a plurality of ribs 120, preferably five in number. Each rib 120 has a rib sidewall 122, a rib base 124, and a groove 126 which is formed therein. The grooves 126 are aligned in the adjacent ribs 120 such that when one food tray is stacked on top of another, for storage purposes, the transverse sidewall portions 110 cooperatively engage within the corresponding grooves 126 so as to permit the stacking of the food trays in a manner which restrains any shifting. It will also be appreciated that the rib bases 124 are in the same plane with the retention area bottom surface 118.

One other visibly significant component of each food tray 24 are downwardly depending rib members 130 which may be found depending from each retaining area bottom surface 118. As can best be seen in FIG. 7, however, with the exception of the areas around the ribs themselves, the various segments of the downwardly depending rib members 130 have the same approximate dimensions as do the downwardly depending rib structures 60.

The following dimensions are associated with each food tray 24. Each food tray is a maximum of 14⅜"×4⅞". The thickness of the sidewall and base is approximately ⅛", the height of the downwardly depending rib members is also ⅛", and the ribs is also ⅛". The overall height associated with the food tray is approximately 1½". Each rib is spaced apart from the next adjacent rib by approximately ¾". The four detents are each approximately ⅝" long, slightly more than ⅛" high, and are formed having a curved surface with a radius of 1/32". With respect to the grooves 126 they have an approximate height of ⅜".

The last major component of the food tray delivery system 20 of this invention is the lid 28 shown best in FIGS. 1, 11–15. With reference to a comparison of those drawing figures, it will be appreciated that each lid 28 is formed having an upper surface 141 with each upper surface having a planar top portion 142 as well as a rounded top portion 143. Connecting the centrally located planar top portion 142 with the rounded top portion 143 is a top portion sidewall 144. In addition t o having an upper surface 141, each lid has a sidewall 145 comprising an upper sidewall portion 147 and a lower sidewall portion 149. The upper sidewall portion 147 tapers downwardly and outwardly from the upper surface 141 and is characterized by a rounded shoulder 150 intermediate the upper sidewall portion 147 and the rounded top portion 143. There is also a lower sidewall rounded shoulder 152 which is located on the lower sidewall portion 149 adjacent to an intermediate upper surface 154 which is located between the lower rounded shoulder 152 and the upper sidewall portion 147. each lid also has a flange 150 at its lower most point with each flange 155 having a flange top surface 157, a flange sidewall 158 and a flange bottom surface 159. On the interior of the lid are a plurality of nubs 165 which correspond in location to the detents associated with the food trays. These nubs aid in securing the lids to the food trays.

Another significant visual feature of the lid of this invention is a elongated recessed portion 170 having a recessed portion sidewall 171 and a recessed portion rounded shoulder 172 as well as a recessed portion base 174. The recessed portion base 174 has both an upper surface 175 as well as a lower surface 176. Preferably the base 174 is parallel to the planar top portion 142. The sidewalls associated with the recessed portion taper inwardly and downwardly just as the sidewalls do which are associated with the food tray and carrying tray. However, the sidewall 145 of the rib tapers downwardly and outwardly as can best be appreciated from FIG. 15.

With respect to the bottom surface 181 of lid 28, there is a planar bottom portion 182, a rounded bottom portion 183 with a bottom portion sidewall 184 connecting the planar bottom portion 182 and rounded bottom portion 183. The sidewall interior surface 186 can be appreciated as being formed having an upper sidewall portion 187 as well as a lower sidewall portion 189. The nubs 165 are formed as part of the lower sidewall portion 189. The upper sidewall portion 187 has an upper sidewall rounded shoulder 190 associated therewith with the rounded shoulder being between the rounded bottom portion 183 and the upper sidewall portion 187. Similarly, there is a lower sidewall rounded shoulder 192 located between the intermediate lower surface 194 and the lower sidewall portion 189.

The following dimensions are associated with the lids 28. The overall maximum dimensions associated with the lid are approximately 4⅜"×4⅞". The height is approximately 1½", the depth associated with the recessed area is ¾", the width is 1½", with the sidewalls tapering inwardly and downwardly from the maximum width of 1½", the thickness of the lid is less than ⅛". The length of each nub is approximately ½". As opposed to the carrying tray and food tray which are preferably formed from high density polyethylene, the lid is formed from a polycarbonate material such that is transparent. This is especially beneficial in the corrections environment, since it readily permits the inspection of each food tray prior to it being delivered.

The food tray delivery system 20 associated with this invention permits the easy stacking of carrying tray upon carrying tray, food tray upon food tray and lid upon lid, all for purposes of storage. More importantly though, the food tray delivery system of this invention is configured ,such that when assembled as shown in FIG. 1, multiple food tray delivery systems may be stacked upon one another to facilitate the delivery of an entire meal. Furthermore, a food tray may be filled with food and a lid cooperatively engaged to the food tray such that additional food tray/lid units may be stacked thereon thereby facilitating prepackaging of meals. Still further, the food tray delivery system of this invention is adaptable so as to permit the passage of food into a cell whose opening may be too narrow to accommodate other wider food delivery trays.

Preferably the food trays are formed such that some are of a red shade, while others are the blue shade, with the red food trays being used for the storage and serving of hot foods with the blue food trays being used for the storage and serving of cold or room temperature foods. The downwardly depending ribs 60 can engage with the lid of an adjacent stacked unit, just as the downwardly depending rib members 130 can engage with the lids of adjacent stacked units. Additionally, the food tray delivery system of this invention is reusable. Finally, the recessed area of the lid can accommodate the appropriate flatware and napkin.

While the form of apparatus herein described constitutes a preferred embodiment of the invention, it is to be understood that the invention is not limited to this precise form of apparatus, and that changes may be made therein without departing from the scope of the invention which is defined in the appended claims.

What is claimed is:

1. A food tray delivery system for serving food to an individual comprising, a carrying tray, said carrying tray comprising a base and a generally upwardly extending sidewall, said base having an upper surface and a lower surface, two food trays, each of said food trays comprising at least one food retention area and a bottom surface said bottom surface having downwardly depending ribs, said food retention area comprising a food retention area upper surface and a generally upwardly extending sidewall, said carrying tray adapted to carry said food tray, and a lid, said lid adapted to cooperate with said downwardly depending ribs, said lid and food tray adapted to cooperatively fit together.

2. The food tray delivery system according to claim 1 wherein said food tray includes a plurality of food retention areas, said food retention areas separated by a transverse sidewall, each said transverse sidewall connected to said food tray sidewall.

3. The food tray delivery system according to claim 1 wherein a food tray has three food retention areas.

4. The food tray delivery system according to claim 1 wherein said lid includes a recessed area.

5. The food tray delivery system according to claim 1 wherein a first food tray is of a first color and a second food tray is of a second color.

6. A food tray delivery system for serving food to an individual comprising, a carrying tray, said carrying tray comprising a base and a generally upwardly extending sidewall, said base having an upper surface and a lower surface, two food trays, each said food tray comprising three food retention areas, said food retention area comprising a food retention area upper surface and a generally upwardly extending sidewall, said food retention areas separated by a transverse sidewall, each said transverse sidewall connected to said food tray sidewall, each food tray having a bottom surface, said bottom surface having downwardly depending ribs, said carrying tray adapted to carry said food tray, and a lid, said lid having a recessed area, said lid and food tray adapted to cooperatively fit together, said lid adapted to cooperate with said downwardly depending ribs.

7. The food tray delivery system according to claim 6 wherein said food tray has a bottom surface with a plurality of ribs adjacent thereto, said ribs having formed therein grooves, said grooves being aligned such that the transverse sidewall portions of a first food tray cooperatively engage within the corresponding grooves of a second food tray so as to permit the stacking of said food trays.

8. The food tray delivery system according to claim 6 wherein the first food tray is of a first color and the second food tray is of a second color.

9. A food tray delivery system for serving food to an individual comprising, a carrying tray, said carrying tray comprising a base and a generally upwardly extending sidewall, said base having an upper surface and a lower surface, at least two food trays, each of said food trays comprising a plurality of food retention areas, each of said food retention areas comprising a food retention area upper surface and a generally upwardly extending food tray sidewall, each of said food retention areas separated by a transverse sidewall, each said transverse sidewall connected to said food tray sidewall, each food tray having a bottom surface with a plurality of ribs adjacent thereto, said ribs having formed therein grooves, said grooves being aligned such that the transverse sidewall portions of a first food tray cooperatively engage within the corresponding grooves of a second food tray so as to permit the stacking of said food trays, said carrying tray adapted to carry said food tray, and a lid, said lid and food tray adapted to cooperatively fit together.

10. The food tray delivery system according to claim 9 wherein each food tray has three food retention areas.

11. The food tray delivery system according to claim 9 wherein said lid includes a recessed area.

12. The food tray delivery system according to claim 9 wherein a first food tray is of a first color and a second food tray is of a second color.

* * * * *